US009533741B2

(12) United States Patent
Parkinson et al.

(10) Patent No.: US 9,533,741 B2
(45) Date of Patent: Jan. 3, 2017

(54) STAND UP PADDLE BOARD

(71) Applicants: Ian Parkinson, Hamilton (CA); Kerri Kelly, Hamilton (CA)

(72) Inventors: Ian Parkinson, Hamilton (CA); Kerri Kelly, Hamilton (CA)

( * ) Notice: Subject to any disclaimer, the term of this patent is extended or adjusted under 35 U.S.C. 154(b) by 0 days.

(21) Appl. No.: 15/077,154

(22) Filed: Mar. 22, 2016

(65) Prior Publication Data

US 2016/0280338 A1 Sep. 29, 2016

Related U.S. Application Data

(60) Provisional application No. 62/138,500, filed on Mar. 26, 2016.

(51) Int. Cl.
*B63H 16/04* (2006.01)
*B63B 35/79* (2006.01)

(52) U.S. Cl.
CPC ..... *B63B 35/7906* (2013.01); *B63H 16/04* (2013.01)

(58) Field of Classification Search
CPC ..... B63H 16/105; B63H 16/04; B63H 1/32
See application file for complete search history.

(56) References Cited

U.S. PATENT DOCUMENTS 4,805,546 A * 2/1989 Geller ..... B63B 35/7926 114/127
6,890,226 B2 * 5/2005 Wang ..... B63H 16/04 440/101
2014/0017963 A1 * 1/2014 Lazarovits ..... B63B 35/7906 441/74

FOREIGN PATENT DOCUMENTS

DE 3141738 A1 * 7/1983 ..... B63H 16/12

* cited by examiner

*Primary Examiner* — Edwin Swinehart

(57) ABSTRACT

The present invention is a stand up paddle board with left and right oars attached to left and right transmissions respectively mounted in the hull of the paddle board. The hull of the paddle board also includes a bow, stern and foot pads upon which the operator stands on. The oars pivot around an oar pivot in a longitudinal direction and paddle arms attached to the oars pivot around an arm pivot in a longitudinal direction. The paddle arms terminate in at a lower at a paddle so that when the operator urges the oars in a rearward and forward motion, the paddle arms pivot around an arm pivot and propel the paddle board.

13 Claims, 7 Drawing Sheets

STAND UP PADDLE BOARD

This application claims priority from the previously filed provisional application no. 62/138,500, filed on Mar. 26, 2015 by Ian Parkinson and Kerri Kelly under the title: Stand Up Paddle Board.

FIELD OF THE INVENTION

The current concept relates to stand up paddle boards and more particularly relates to a new design for a stand up paddle board and method of use.

BACKGROUND OF THE INVENTION

Currently stand up paddle boarding also known as SUP is a relatively new sport which combines surfing with kayaking and canoeing. Stand up paddle boards as the name suggests are manoeuvred in a standing or upright position and provide a full body workout while the width of the board makes it easy to balance on the water. Stand up paddle boards normally are propelled with the use of a single paddle which may be single and or double ended depending on the preference of the user. Paddling with a double ended paddle is accomplished in similar fashion as in a kayak whereas paddling with a single ended paddle is accomplished in similar fashion as in a canoe.

The disadvantage with the current paddling techniques on stand up paddle boarding is the constant shifting of weight and balance considerations in moving the weight from one side of the stand up paddle board to the other. Additionally there are the on-going balance concerns and the lack of any other balancing aid on the board other than your feet planted on the board and the end of the paddle in the water.

There is a need for a stand up paddle board which provides for a more efficient and more user friendly method of paddling and which aids in the balance of the user providing for a more enjoyable and safer ride.

SUMMARY OF THE INVENTION

The present invention is a stand up paddle board water craft comprising:

a) a hull which includes a bow and stern and foot pads, wherein the hull is adapted for an operator to stand on the foot pads while underway;

b) a left and a right oar extending upwardly from the hull and attached to a left and right transmission respectively, the transmissions mounted in the hull and includes an oar pivot, each oar pivoting about the oar pivot in a longitudinal direction parallel to a vertical plane;

c) a left paddle arm and a right paddle arm operably connected at an upper end of each paddle arm to the left and right oars respectively at each respective transmission; each paddle arm at a lower end terminating at a paddle;

d) each paddle arm pivoting about an arm pivot, wherein the oars dimensioned to be grasped in the hands of the operator and urged in a rearward and forward motion and wherein the transmissions convert the forward motion of the oar into a forward paddle action and the rearward motion of the oar produces a rearward paddle action to propel the paddle board forward.

Preferably wherein each oar pivoting about the oar pivot in a longitudinal direction parallel to a vertical plane and each paddle arm pivoting about the arm pivot in a longitudinal direction parallel to a vertical plane.

Preferably wherein the left and right paddle arms terminate at a lower end in a left and right folding paddle respectively such that the paddle unfolds into an open position during rearward paddle action and folds into collapsed position during forward paddle action thereby minimizing forward water resistance Preferably wherein each transmission includes a transmission box for housing the transmission, the transmission box mounted through the hull and extending from a top deck top to a hull bottom Preferably wherein the transmissions are equi-spaced away from a longitudinal center and along a common line perpindicular to the longitudinal direction.

Preferably wherein each oar and paddle arm are connected together with a link to the oar at an oar/link connector and to the paddle arm at a paddle arm/link connector.

Preferably wherein the oar/link connector is spaced from the oar pivot by a distance D1 defining an oar lever, and the paddle arm/link connector is spaced from the arm pivot by a distance D2 defining an arm lever, thereby creating a mechanical advantage between the oars and paddles which is the ratio D1/D2.

Preferably wherein the transmission box is a U shaped channel with a bottom opening in a bottom wall.

Preferably wherein the transmission further including upper flanges for mounting the transmission onto an upper deck.

Preferably wherein the folding paddles folding in duck feet fashion collapsing into collapsed position on forward paddle action through the water, and opening into open position on rearward paddle action through the water.

Preferably wherein the right oar and left oar resist any motion other than forward and rearward motion thereby aiding the operator's balance on the paddle board.

Preferably wherein the transmission includes a forward stop and a rear stop limiting the amount the oars can pivot in the forward and rear motions wherein further movement of the oars will be resisted by the stops further aiding the operator's balance on the paddle board.

Preferably wherein the transmission further includes an open top and closed sidewalls such that the oars are received through the open top and the paddle arms are received through the bottom opening.

Preferably wherein the link moves in a substantially longitudinal direction along link action direction.

The present invention is also in combination a water craft paddle board and a propulsion system, the combination comprising:

a) a hull which includes a bow, a stern, a bottom, and a top which includes foot pads wherein the hull is adapted for an operator to stand on the foot pads while underway;

b) the propulsion system includes left and right oars extending upwardly from the hull to a preselected height above the hull top, the oars positioned to the left and right of a longitudinal center of the hull such that the operator stands behind the oars and grips an oar in each hand while in a standing position;

c) the left and right oars are attached at a oar bottom end to a left and right transmission respectively, the transmissions mounted in the hull and includes an oar pivot, each oar pivoting about the oar pivot in a longitudinal direction parallel to a vertical plane;

d) the propulsion system includes a left paddle arm and a right paddle arm operably connected at an paddle arm top end of each paddle arm to the left and right oars respectively at each respective transmission; each paddle arm at a lower end terminating at a folding paddle;

e) each paddle arm pivoting about an arm pivot in a longitudinal direction parallel to a vertical plane, wherein the oars dimensioned to be grasped in the hands of the operator and urged in a rearward and forward motion and wherein the transmissions convert the forward motion of the oar into a forward paddle action and the rearward motion of the oar produces a rearward paddle action to propel the paddle board forward.

BRIEF DESCRIPTION OF THE DRAWINGS

The present concept with now be described by way of example with reference to the following drawings in which.

DETAILED DESCRIPTION OF THE PREFERRED EMBODIMENTS

Figure 1:
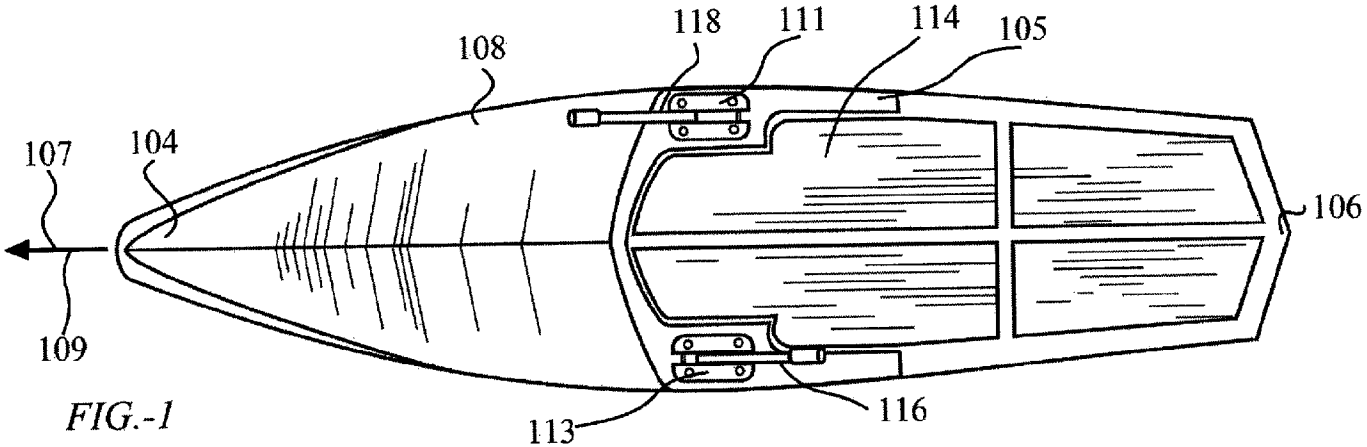
FIG. 1 is a top schematic plan view of a stand up paddle board and method of use.

The present concept a stand up paddle board and method of use is shown generally as 100 in the Figures and includes the following major components namely hull 102, adding a bow 104, and a stern 106, a top 108, a bottom 110, a deck 112 and foot pads 114. A line running through the centre of the hull extending from the bow to the center of the stern is a longitudinal center 109 in the front/back direction and is also depicted as longitudinal direction 107.

Stand up paddle board and method of use 100 further includes a left oar 116, a right oar 118, a left handle 120 and a right handle 122 located near the top end 124 of each of the oars. The left and right oars 116 and 118 are connected to left and right transmissions 113 and 111 respectively as are left and right paddle arms 130 and 132.

Figure 2:
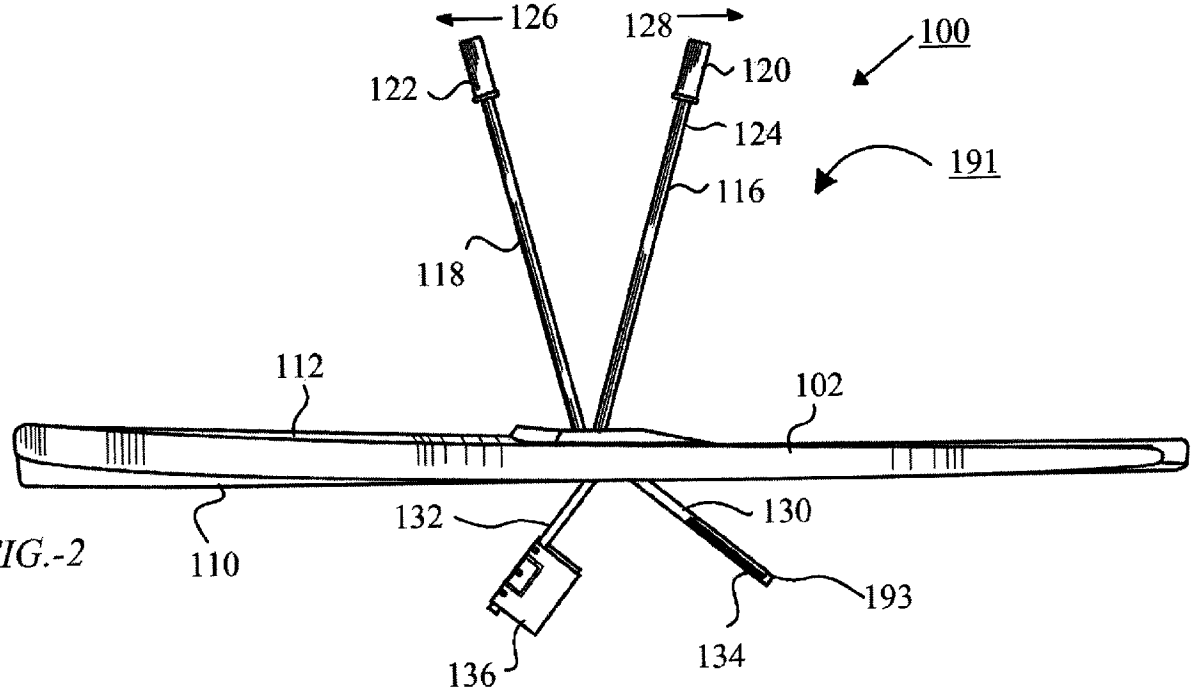
FIG. 2 is a side elevational schematic view of the stand up paddle board and method of use.

The oars 116 and 118 are either pulled in the rearward motion 128 and/or pushed in a forward motion 126 as shown by the arrows in FIG. 2.

Figure 4:
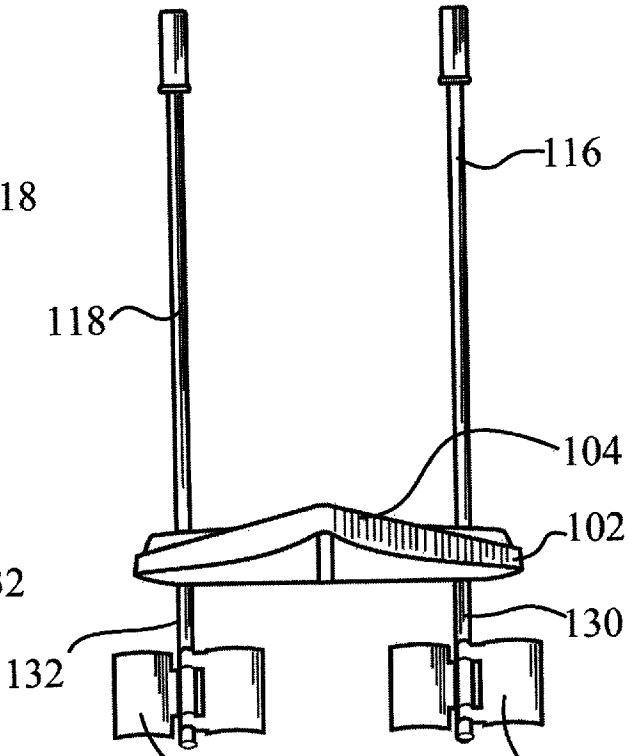
FIG. 4 is a front schematic plan view of the stand up paddle board and method of use.
Figure 3:
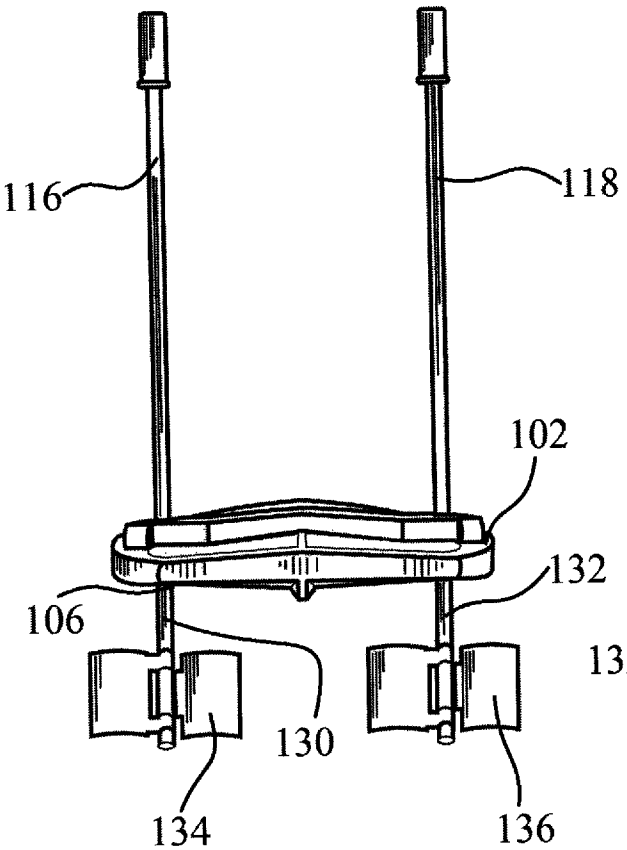
FIG. 3 is a rear schematic plan view of the stand up paddle board and method of use.

Stand up paddle board and method of use 100 further includes a left paddle arm 130, a right paddle arm 132 each of the paddle arms connected to a left folding paddle 134 and a right folding paddle 136. The rearward motion 128 and forward motion 126 of the left oar 116 and the right oar 118 are transmitted through a transmission to the left paddle arm 130 and right paddle arm 132 respectively. The paddle arms extend vertically substantially perpendicular to the hull when viewed along the longitudinal direction as shown in FIGS. 3 and 4. The paddle arms pivot back and forth in a longitudinal plane about the transmission 180 however resist lateral pressure applied to the oars and oar handles 120, 122 . The lateral direction is transverse to the longitudinal in other words left/right or in this case a line connecting the two transmissions along the hull is the lateral direction.

Figure 5:
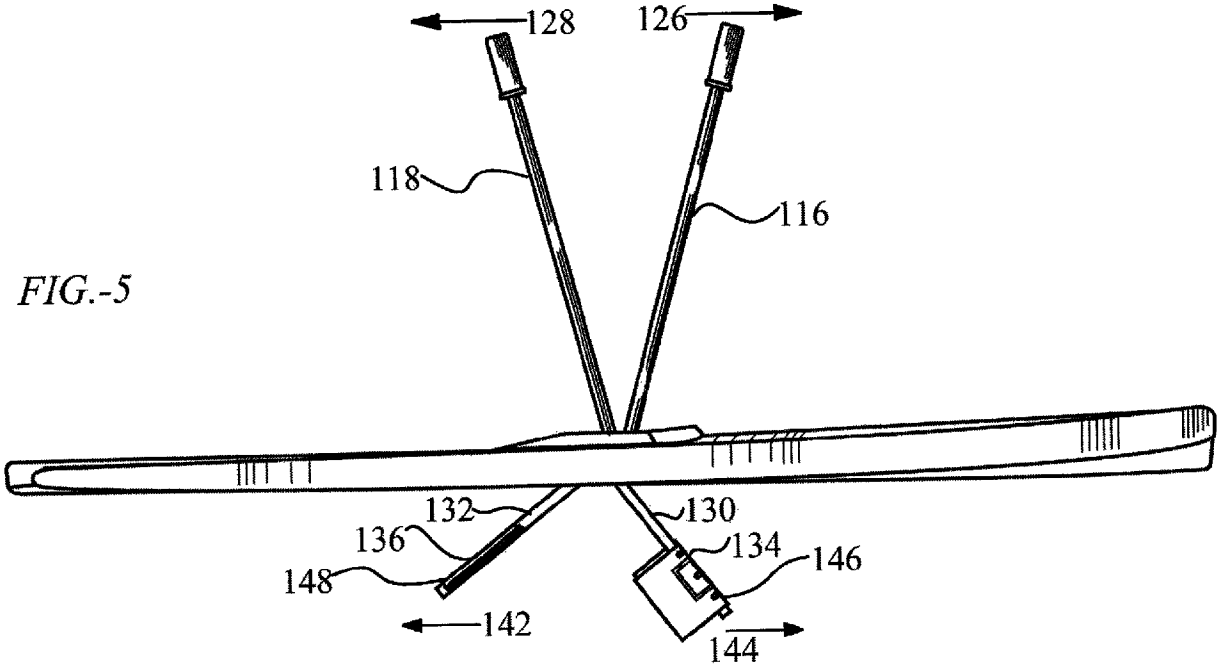
FIG. 5 is a right side schematic elevational view of the stand up paddle board and method of use.

Referring now to FIG. 5 rearward motion 128 on right oar 118 results in rearward paddle action 142 on right folding paddle 136. This action puts right folding paddle 136 into an open position 148 as shown in FIG. 6.

Forward motion 126 of left oar 116 translates into forward paddle action 144 of left folding paddle 134 resulting in placing left folding paddle 134 into a collapsed position 146.

Figure 6:
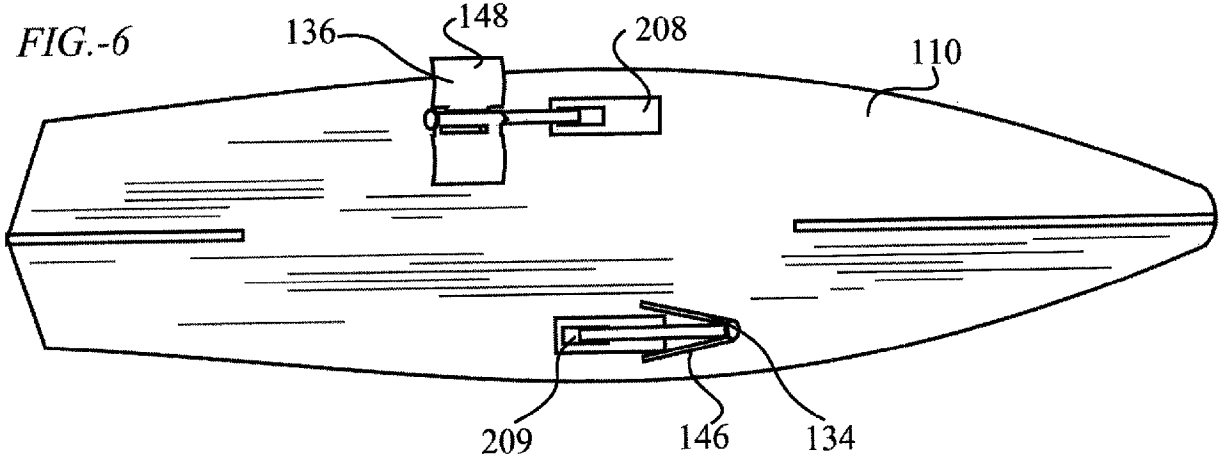
FIG. 6 is a schematic bottom plan view of the stand up paddle board and method of use.

Therefore as a paddle is driven forwardly towards the bow 104 of hull 102 the folding paddle will collapse into the collapsed position 146 and as the paddle is driven rearwardly toward the stern 106 of hull 102 the folding paddles will open into the open position 148 as shown in FIG. 6.

Figures 7, 8:
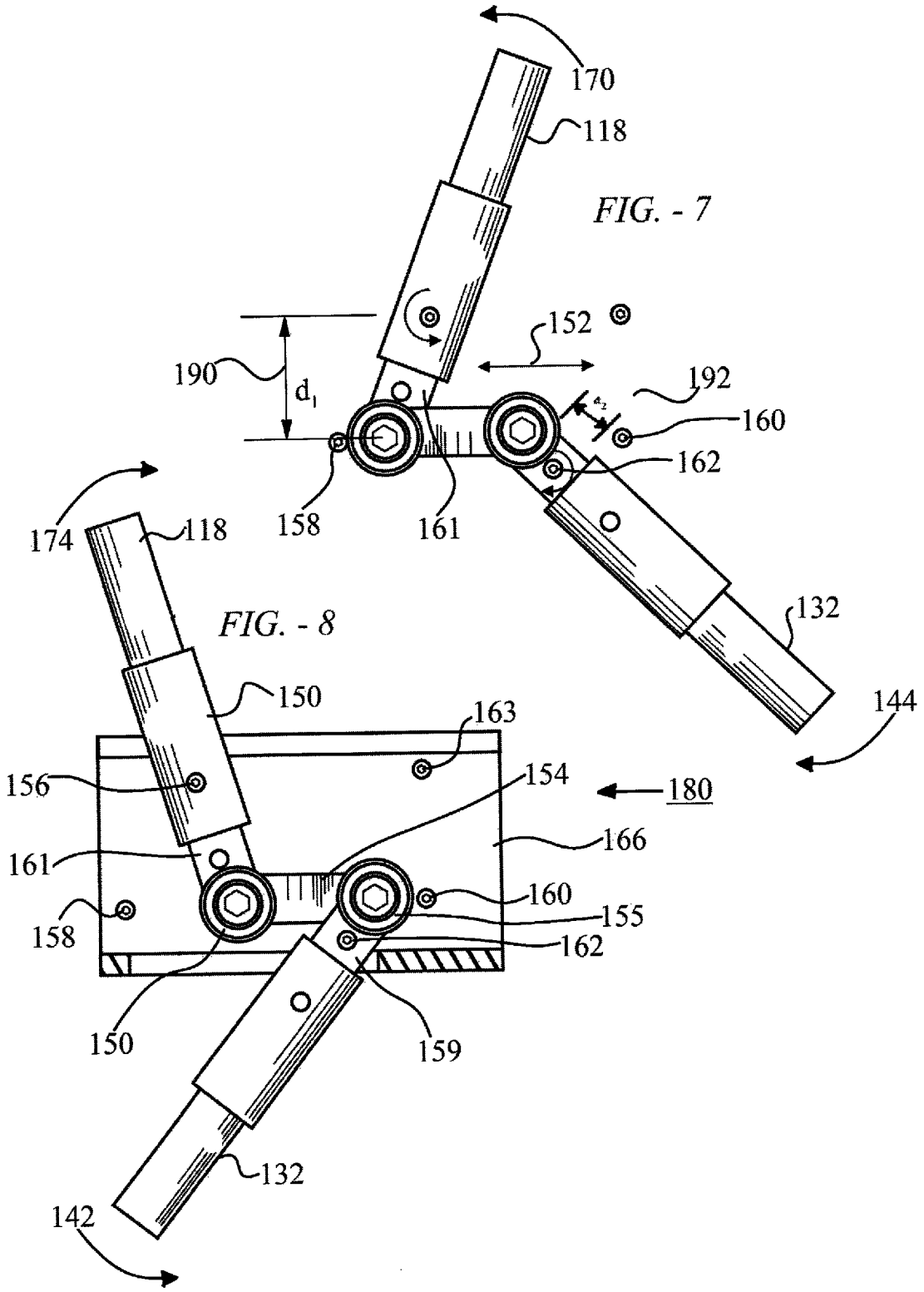
FIG. 7 is a schematic plan view of some components of the transmission used in the stand up paddle board and method of use.
FIG. 8 is a schematic plan view of some components of the transmission used in the stand up paddle board and method of use.
Figure 9:
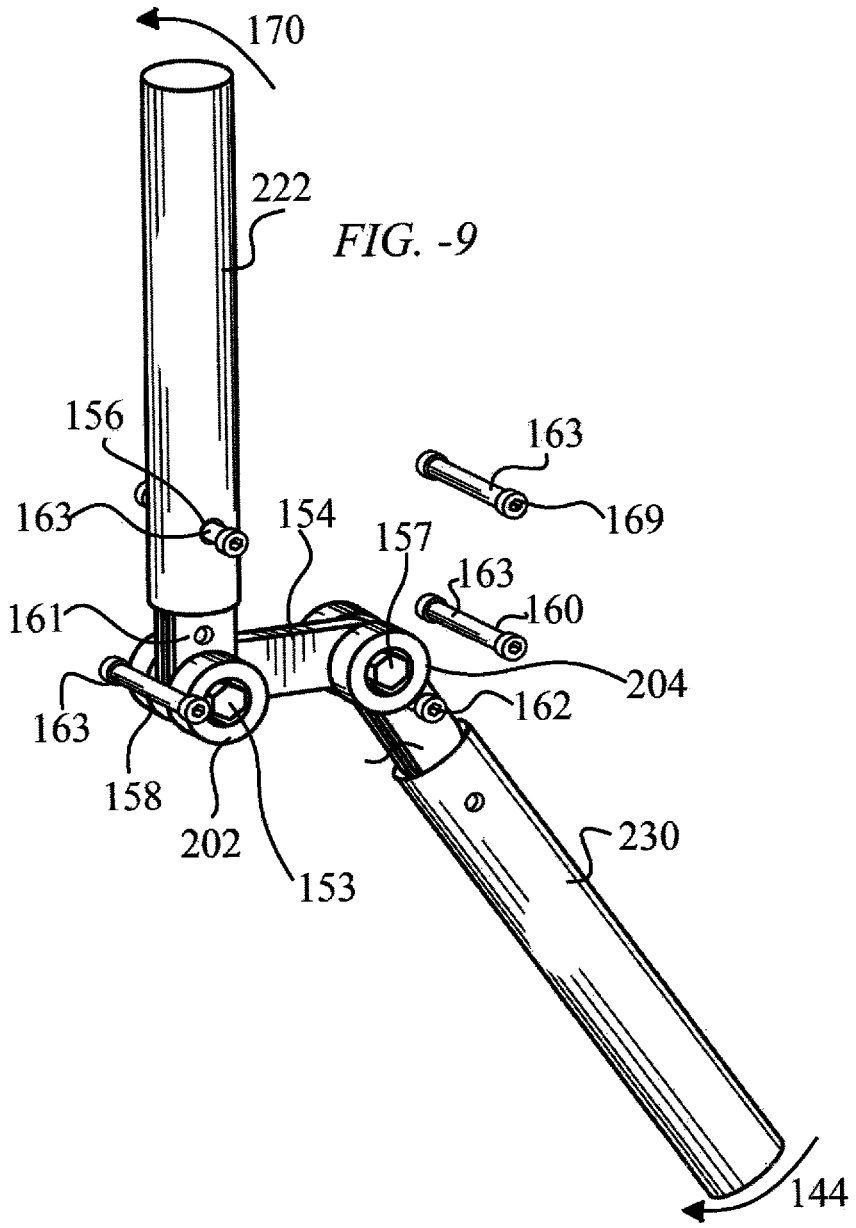
FIG. 9 is a side schematic perspective view of some of the components used in the transmission.

Referring now to FIGS. 7, 8 & 9 which show components of the transmission without the obstruction of the transmission box including the oars and paddles these components will include a right oar for example 108 includes oar bottom end 161 which terminates at an oar/link connector 150 which is connected front link end 153 of link 154. Right oar 118 for example pivots about oar pivot 156 thereby urging link 154 along link action direction 152 shown in FIG. 7.

Right paddle arm 132 for example includes paddle arm top end 159 which is connected at paddle arm/link connector 155 to rear link end 157 of link 154 and pivots about arm pivot 162. Left oar 116 and left paddle arm 130 function in analogous fashion.

Transmission 180 includes transmission box 166 and further includes a forward stop 158, a rear stop 160 and oar pivot 156 and an arm pivot 162 and a number of spacers 163 and bolts 169. The mechanical advantage or leverage between the oar 118 and the paddle arm 132 is dependent upon the distance of the oar lever D1 shown as 190 and the distance of the arm lever D2 shown as 192. Oar lever D1 190 is the distance between oar pivot 156 and the center of oar/link connector 150. Arm lever D2 192 is the distance between arm pivot 162 and the center of paddle arm/link connector 155

The mechanical advantage is proportional to D1/D2 meaning that if Dl/D2 is 2 for example, the paddle arm will travel twice the distance as the oar at an equivalent distance from each respective pivot point.

Forward oar action shown as 170 in FIG. 7 results in forward paddle action 144 shown in FIG. 7.

Rear oar action 174 shown in FIG. 8 results in rear paddle action 142 shown in FIG. 8.

Link 154 is urged forwardly and backwardly along link action direction 152.

The amount of forward oar action 170 and rear oar action 174 is limited by forward stop 158 and rear stop 160.

In FIG. 7 right oar 118 is against the forward stop 158 whereas in FIG. 8, right paddle arm 132 is almost against the rear stop 160.

Each of the ends of the oars and the paddles in the transmission 180 include oar bushing 202 at oar/link connector 150 and arm bushings 204 at paddle arm/link connector 155. These bushings abut up against forward stop 158 and rear stop 160 therefore cushioning the forward and backstops.

Figure 10:
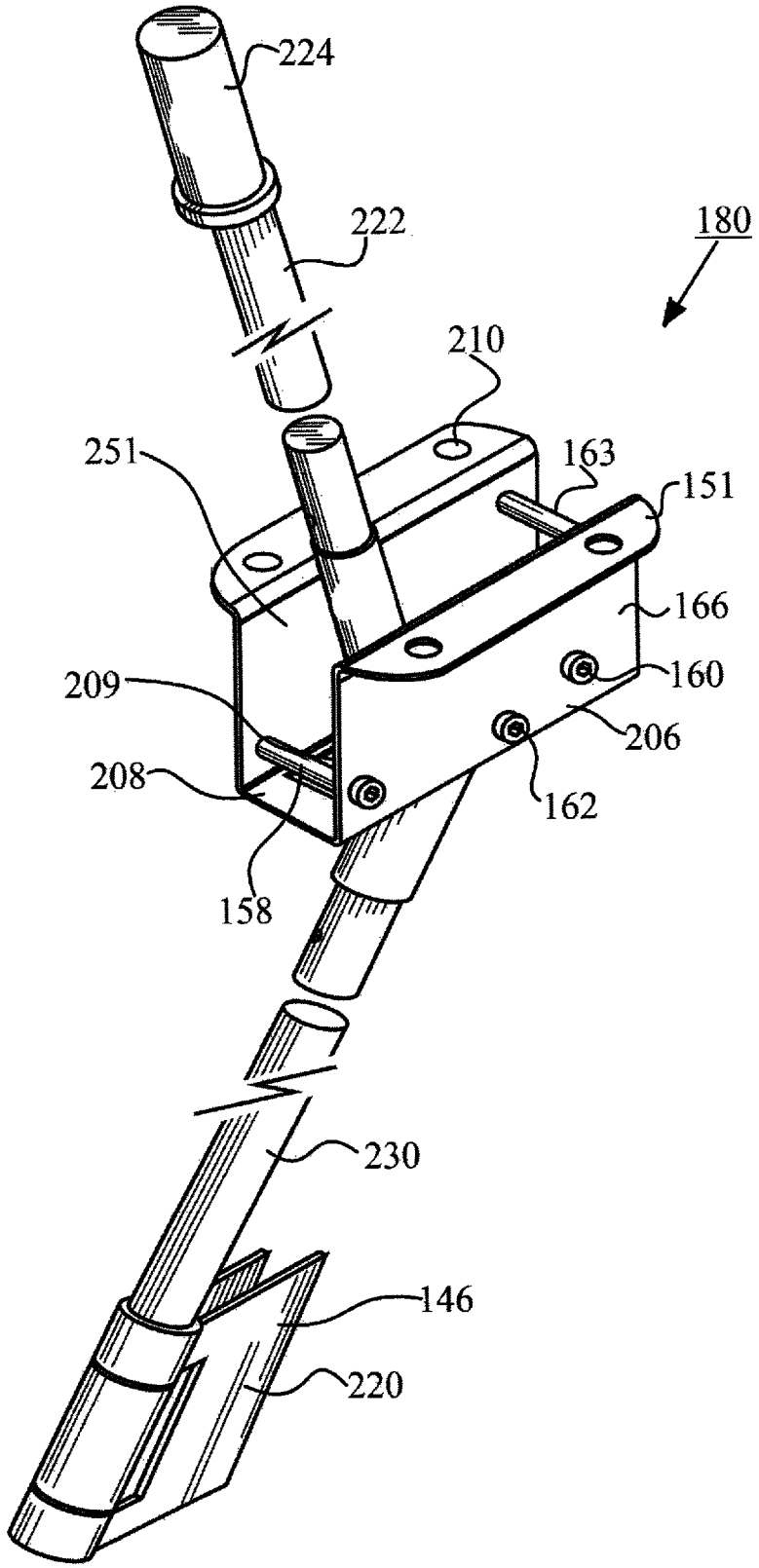
FIG. 10 is a schematic perspective view of some components of the transmission together with the oars and paddles.

Referring now to FIG. 10 which schematically shows components of transmission 180 along with paddle arm 230, paddle 220, oar 222 and oar handle 224.

Transmission 180 includes a transmission box 166 having an upper flange 151, two side walls 206, an open top 251 and a bottom wall 208 with a bottom opening 209.

Along upper flange 151 are depicted four apertures 210 for mounting the transmission box 166 into the top deck 105 hull 102 of stand up paddle board and method of use 100.

Figure 11:
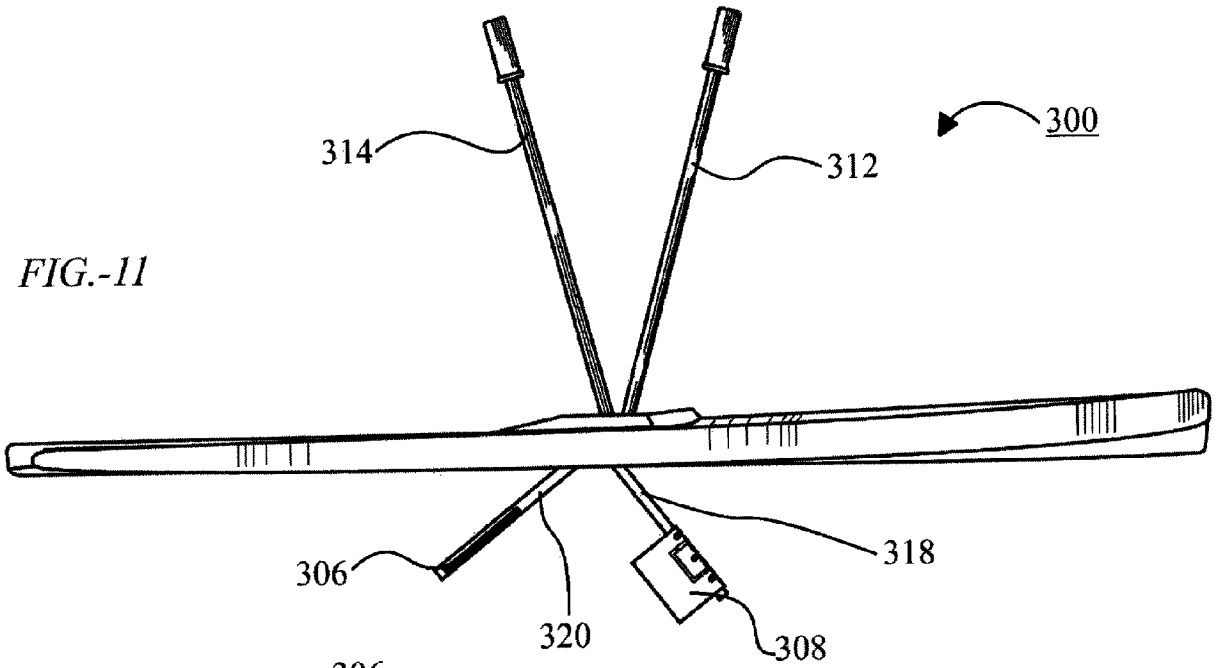
FIG. 11 is a right side schematic elevational view of an alternate embodiment the stand up paddle board and method of use.
Figure 12:
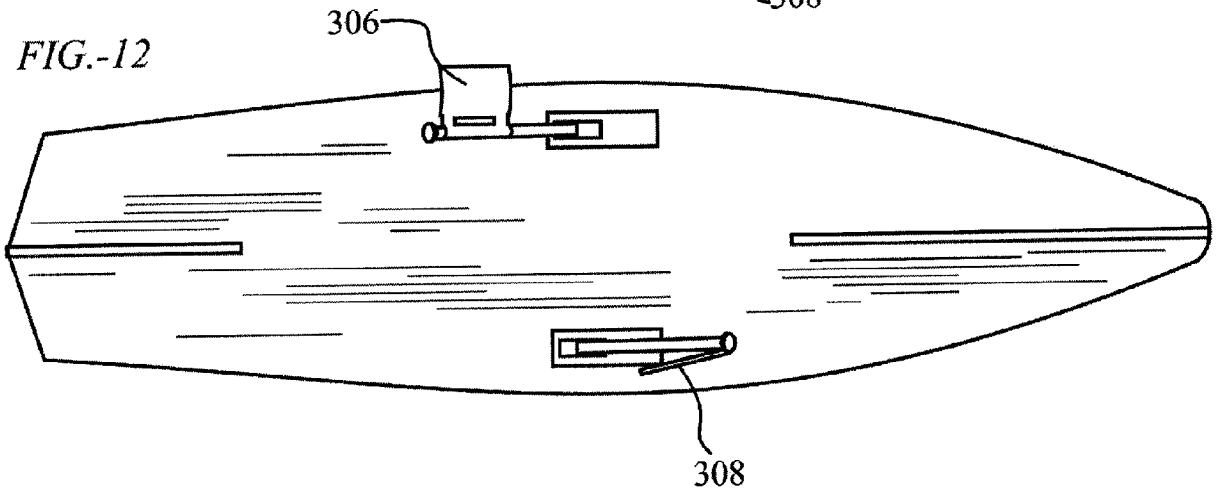
FIG. 12 is a schematic bottom plan view of the stand up paddle board and method of use shown in FIG. 11.

Referring to FIGS. 11 and 12 which depicts a stand up paddle board 300 with single bladed left and right folding paddles 308 and 306 respectively. Stand up paddle board 300 also includes left and right oars 312 and 314 and left and right paddle arms 318 and 320 as shown. The stand up paddle board 100 is a water craft and a combination of a paddle board which is the hull 102 portion and a propulsion system 191. The combination includes a hull 102 which includes a bow 104, a stern 106, a bottom 110, and a top 108 which includes foot pads 114 wherein the hull 102 is adapted for an operator to stand on the foot pads 114 while underway.

The propulsion system includes left and right oars 116, 118 extending upwardly from the hull 102 to a preslected height above the hull top and positioned to the left and right of a longitudinal center of the hull such that the operator stands behind the oars and grips an oar in each hand while in a standing position.

Left and right oars 116, 118 are attached at an oar bottom end 161 to a left and right transmission 113, 111 respectively, the transmissions mounted in the hull 102 and includes an oar pivot 156, each oar pivoting about the oar pivot 156 in a longitudinal direction parallel to a vertical plane such that all forces on the oars are resisted except forward and rear oar actions 170, 174.

The propulsion system includes a left paddle arm 130 and a right paddle arm 132 operably connected at an paddle arm top end 159 of each paddle arm to the left and right oars 116,118 respectively at each respective transmission 111, 113 such that a lower end 193 of each paddle arm terminating at a folding paddle 134, 136.

Each paddle arm 130, 132 pivoting about an arm pivot 162 in a longitudinal direction parallel to a vertical plane, wherein the oars dimensioned to be grasped in the hands of the operator and urged in a rearward and forward motion 128, 126 and wherein the transmissions convert the forward motion of the oar into a forward paddle action 144 and the rearward motion of the oar produces a rearward paddle action 142 to propel paddle board 100 forward.

In Use

In use, folding paddles 134 and 136 in similar fashion as ducks' feet operate by collapsing on forward motion through the water, and opening in rearward motion through the water. This reduces the resistance against the paddle and allows efficient progress through the water. On rearward paddle action 142 left and right folding paddles 134 and 136 unfold into open position 148 which creates resistance thereby propelling the stand up paddle board forward.

A user stands on paddle board 100 with feet planted on foot pads 114 and grasps handles 120 and 122.

The user is able to better balance on the board since left and right oars 116 and 118 can be used to stabilize due to the fact the oars will resist forces that are applied to the handles 122 and 120 except in the rearward and forward motion 128 and 126.

In a preferred embodiment oars 116 and 118 are operated by the user in any paddle motion. The user can simultaneously or alternatively push oars 116 and 118 in a forward motion 126 towards bow 104 thereby producing forward paddle action 144. Transmission 180 operates by translating forward oar action 170 into link action 152 to create forward paddle action 144. This moves paddle 136 or 220 into collapsed position 146 and allows for paddle movement with reduced drag through the water.

The user then pulls both oars simultaneously or alternatively in rear oar action 174 produced by rearward motion 128 towards stern 106 which is translated by transmission 180 into rear paddle action 142. This moves paddle 134 or 220 into open position 148 and propels stand up paddle board 100 forward (bow 104 first) through the water.

In an alternative embodiment, oars 116 and 118 are operated in alternating pulls. Left oar 116 is pushed in rearward motion 128 and right oar 118 is pushed in forward motion 126 such that left folding paddle 134 is urged in rear paddle action 142 in an open position 148 and right folding paddle 136 is urged in a forward paddle action 144 such that propulsion of the board is alternated between the left and right paddles 134, 136.

It should be apparent to persons skilled in the arts that various modifications and adaptation of this structure described above are possible without departure from the spirit of the invention the scope of which defined in the appended claim.

We claim:

1. A stand up paddle board water craft comprising:

a) a hull which includes a bow and stem and foot pads, wherein the hull is adapted for an operator to stand on the foot pads while underway;

b) a left and a right oar extending upwardly from the hull and attached to a left and right transmission respectively, the transmissions mounted in the hull and includes an oar pivot, each oar pivoting about the oar pivot in a longitudinal direction parallel to a vertical plane;

c) a left paddle arm and a right paddle arm operably connected at an upper end of each paddle arm to the left and right oars respectively at each respective transmission; each paddle arm at a lower end terminating at a paddle;

d) each paddle arm pivoting about an arm pivot, wherein the oars dimensioned to be grasped in the hands of the operator and urged in a rearward and forward motion and wherein the transmissions convert the forward motion of the oar into a forward paddle action and the rearward motion of the oar produces a rearward paddle action to propel the paddle board forward;

e) wherein each oar and paddle arm are connected together with a link to the oar at an oar/link connector and to the paddle arm at a paddle arm/link connector.

2. The stand up paddle board water craft claimed in claim 1 wherein each oar pivoting about the oar pivot in a longitudinal direction parallel to a vertical plane and each paddle arm pivoting about the arm pivot in a longitudinal direction parallel to a vertical plane.

3. The stand up paddle board water craft claimed in claim 1 wherein the left and right paddle arms terminate at a lower end in a left and right folding paddle respectively such that the paddle unfolds into an open position during rearward paddle action and folds into collapsed position during forward paddle action thereby minimizing forward water resistance.

4. The stand up paddle board water craft claimed in claim 1 wherein each transmission includes a transmission box for housing the transmission, the transmission box mounted through the hull and extending from a top deck top to a hull bottom.

5. The stand up paddle board water craft claimed in claim 1 wherein the transmissions are equi-spaced away from a longitudinal center and along a common line perpindicular to the longitudinal direction.

6. The stand up paddle board water craft claimed in claim 1 wherein the oar/link connector is spaced from the oar pivot by a distance D1 defining an oar lever, and the paddle arm/link connector is spaced from the arm pivot by a distance D2 defining an arm lever, thereby creating a mechanical advantage between the oars and paddles which is the ratio D1/D2.

7. The stand up paddle board water craft claimed in claim 4 wherein the transmission box is a U shaped channel with a bottom opening in a bottom wall.

8. The stand up paddle board water craft claimed in claim 7 wherein the transmission further including upper flanges for mounting the transmission onto an upper deck.

9. The stand up paddle board water craft claimed in claim 1 wherein the folding paddles folding in duck feet fashion collapsing into collapsed position on forward paddle action through the water, and opening into open position on rearward paddle action through the water.

10. The stand up paddle board water craft claimed in claim 1 wherein the right oar and left oar resist any motion other than forward and rearward motion thereby aiding the operator's balance on the paddle board.

11. The stand up paddle board water craft claimed in claim 7 wherein the transmission further includes an open top and closed sidewalls such that the oars are received through the open top and the paddle arms are received through the bottom opening.

12. The stand up paddle board water craft claimed in claim 1 wherein the link moves in a substantially longitudinal direction along link action direction.

13. A stand up paddle board water craft comprising:

a) a hull which includes a bow and stern and foot pads, wherein the hull is adapted for an operator to stand on the foot pads while underway;

b) a left and a right oar extending upwardly from the hull and attached to a left and right transmission respectively, the transmissions mounted in the hull and includes an oar pivot, each oar pivoting about the oar pivot in a longitudinal direction parallel to a vertical plane;

c) a left paddle arm and a right paddle arm operably connected at an upper end of each paddle arm to the left and right oars respectively at each respective transmission; each paddle arm at a lower end terminating at a paddle;

d) each paddle arm pivoting about an arm pivot, wherein the oars dimensioned to be grasped in the hands of the operator and urged in a rearward and forward motion and wherein the transmissions convert the forward motion of the oar into a forward paddle action and the rearward motion of the oar produces a rearward paddle action to propel the paddle board forward;

e) wherein the transmission includes a forward stop and a rear stop limiting the amount the oars can pivot in the forward and rear motions wherein further movement of the oars will be resisted by the stops further aiding the operator's balance on the paddle board.

* * * * *